United States Patent [19]

Miyazawa

[11] 4,325,683

[45] Apr. 20, 1982

[54] SCROLL-TYPE COMPRESSOR WITH ROTATION PREVENTION AND ANTI-DEFLECTION MEANS

[75] Inventor: Kiyoshi Miyazawa, Annaka, Japan

[73] Assignee: Sankyo Electric Company Limited, Isesaki, Japan

[21] Appl. No.: 88,583

[22] Filed: Oct. 26, 1979

[30] Foreign Application Priority Data

Oct. 30, 1978 [JP] Japan ..... 53-134173
Oct. 30, 1978 [JP] Japan ..... 53-134175

[51] Int. Cl.[3] ..... F04C 18/02; F16D 3/04
[52] U.S. Cl. ..... 418/55; 64/31
[58] Field of Search ..... 418/55, 57; 64/31

[56] References Cited

U.S. PATENT DOCUMENTS 3,874,827 4/1975 Young ..... 418/55
4,082,484 4/1978 McCullough ..... 418/55

FOREIGN PATENT DOCUMENTS 932871 12/1947 France ..... 64/31

*Primary Examiner*—John J. Vrablik
*Attorney, Agent, or Firm*—Hopgood, Calimafde, Kalil, Blaustein & Judlowe

[57] ABSTRACT

A scroll-type refrigerant compressor unit is provided in which any deflections and undesired vibrations of the moving parts are prevented by a simple construction and in which the orbiting scroll member is prevented from rotating by a simple mechanism. The disk rotor having the drive pin is mounted on an inner end of a drive shaft which is rotatably mounted through the front end plate of the compressor housing. The disk rotor is rotatably supported on the inner surface of the front end plate through a thrust bearing. The orbiting scroll member is rotatably mounted on the drive pin. The orbiting scroll member has a radial flange integrally formed with the scroll member, the flange is supported on the disk rotor through a thrust bearing. Therefore, the drive shaft, the disk rotor, the drive pin and the orbiting scroll member are supported without undesired deflection and vibration during operation. A ring like slider plate member is disposed between the radial flange and the end plate of the orbiting scroll member. The slider member is connected to the end plate of the orbiting scroll member by a key and keyway connection so that the relative rotation is prevented while relative movement in a radial direction is permitted. The slider plate member is also connected to a member fixed to the inner surface of the compressor housing by a key and keyway connection so that relative rotation is prevented while relative movement is permitted in a radial direction perpendicular to the relative movement between the slider member and the orbiting scroll member. The keys and keyways may be preferably formed so that the contact surfaces between mating keys and keyways for receiving rotational torque is on a diameter of the slider member.

7 Claims, 17 Drawing Figures

SCROLL-TYPE COMPRESSOR WITH ROTATION PREVENTION AND ANTI-DEFLECTION MEANS

BACKGROUND OF THE INVENTION

This invention relates to fluid displacement apparatus, and in particular, to fluid compressor units of the scroll type.

Scroll type apparatus has been well known in the prior art as disclosed in, for example, U.S. Pat. No. 801,182 and others, which include two scroll members each having an end plate and a spiroidal or involute spiral element. Scroll members are maintained angularly and radially offset so that both of the spiral elements interfit so as to maintain a plurality of line contacts between the spiral curved surfaces to thereby seal off and define at least one fluid pocket. The relative orbital motion of scroll members shifts the line contacts along the spiral curved surfaces and, therefore, the fluid pocket changes in volume. The volume of the fluid pocket increases or decreases dependent on the direction of the orbital motion. Therefore, scroll-type apparatus is applicable to compress, expand or pump fluids.

In comparison with conventional compressors of the piston type, a scroll-type compressor has advantages such as a lesser number of parts, continuous compression of fluid and others. However, there have been several problems: primarily; sealing of the fluid pocket, wear on the spiral elements, and inlet and outlet porting.

Although many patents, for example, U.S. Pat. Nos. 3,884,599, 3,924,977, 3,994,633, 3,994,635, 3,994,636 have attempted to resolve those and other problems, the resultant compressor is complicated in construction and in production. Furthermore, because a plurality of spaced radial bearings are used to support a drive shaft, the axial length of the drive shaft is increased so that the resultant compressor is increased in total length, in volume and in weight.

In the compressor of this type, it is desired that any deflections and undesired vibrations of moving parts be prevented by simple construction. And it is also desired that the mechanism for preventing the orbiting scroll member from rotating be simple and compact.

SUMMARY OF THE INVENTION

It is an object of this invention to provide a compressor unit of the scroll type which is simple in construction and production, with excellent sealing and resistance to wear, and simple porting.

It is another object of this invention to provide a compressor unit of the scroll type wherein the drive shaft axis and other moving parts axes are securely prevented from deflection during operation.

It is still another object of this invention to provide a compressor unit of the scroll type which has an improved rotation prevention mechanism for the orbiting scroll member.

A compressor unit of the scroll type, according to this invention, comprises a compressor housing having front and rear end plates. A fixed scroll member is disposed within the compressor housing and has first end plate means and first wrap means affixed to the first end plate means. An orbiting scroll member is disposed within the compressor housing and has second end plate means and second wrap means affixed to the second end plate means. The first and second wrap means interfit in a predetermined angular relationship in a plurality of line contacts to define at least one sealed off fluid pocket which moves with a consequent reduction of volume due to the orbital motion of the orbiting scroll member. A drive shaft is rotatably supported by first radial bearing means in the front end plate and extends outwardly through the front end plate. A disk rotor member is mounted on an inner end of the drive shaft and is supported by first thrust bearing means on an inner surface of the front end plate. A drive pin projects axially from a rear surface of the disk rotor member and is radially offset from the axis of the drive shaft. The orbiting scroll member is provided with an axial boss which is disposed on a surface of the second end plate means opposite the second wrap means. The boss is fitted onto the drive pin through second radial bearing means so that the orbiting scroll member is rotatably mounted on the drive pin. A radial flange portion integrally formed extends radially from the projecting end of the axial boss, and is supported by second thrust bearing means on the rear surface of the disk rotor member. Means for preventing the rotation of the orbiting scroll member, but permitting the orbiting scroll member to effect orbital motion, are disposed between the radial flange portion and the second end plate means of the orbiting scroll member.

The rotation preventing means comprise a ring plate slider member disposed around the axial boss and having a first pair of radial key projections projecting from opposite ends of a diameter thereof on an axial end surface thereof and a second pair of key projections projecting from opposite ends of another diameter perpendicular to the diameter on the other axial end surface thereof. Fixed guide means are fixedly disposed within the compressor housing and have a first pair of keyways in which the first key projections are received to permit radial movement of the slider member along the first keyways. The second end plate of the second scroll member has a second pair of keyways in which the second pair of key projections are received to permit radial movement of the slider member along the second keyways.

The first key projections may be advantageously formed offset from one another so that the side surfaces of respective first key projections receiving a relative rotational force between the slider member and the fixed guide means are located on the diameter of the ring plate slider member, and the second key projections are formed offset from one another so that side surfaces of respective second key projections receiving a relative rotational force between the slider member and the second scroll member are located on the other diameter of the ring plate slider member.

The first and second pair of key projections may be alternatively formed on the fixed guide means and the second end plate means of the second scroll member, respectively. And the first and second keyways may be formed in the opposite end surfaces of the ring plate slider members, respectively.

Further objects, features and other aspects will be understood from the detailed description of the preferred embodiments of this invention with reference to the annexed drawings.

DETAILED DESCRIPTION OF PREFERRED EMBODIMENTS

Figure 1:
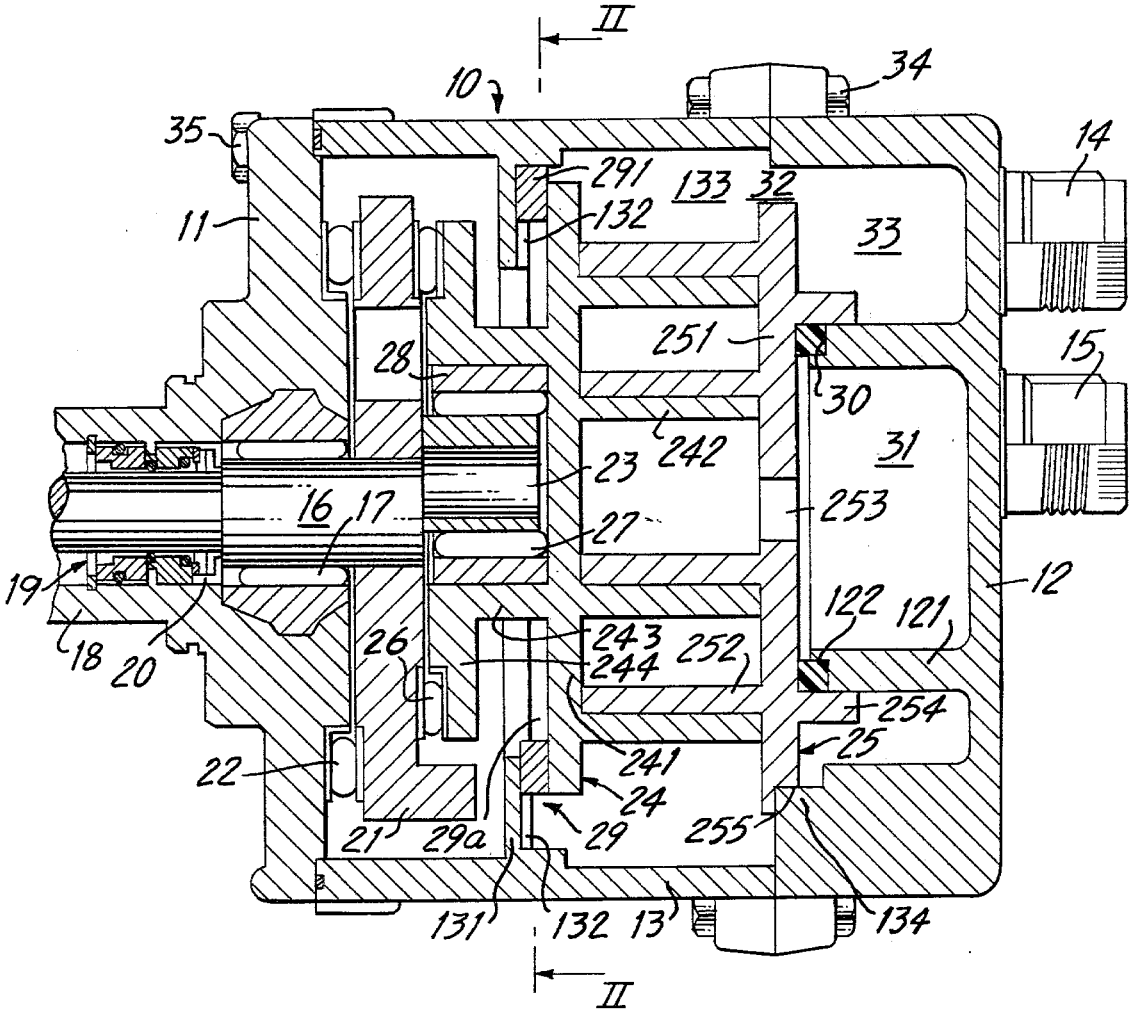
FIG. 1 is a vertical sectional view of a compressor unit of the scroll-type according to an embodiment of this invention.

Referring to FIG. 1, a refrigerant compressor unit 10 of the embodiment shown includes a compressor housing including a front end plate 11, a rear end plate 12 and a cylindrical housing 13 connecting the end plates. Rear end plate 12 is provided with a fluid inlet port 14 and a fluid outlet port 15 formed therewith. A drive shaft 16 is rotatably supported by a radial needle bearing 17 in front end plate 11. Front end plate 11 has a sleeve portion 18 projecting from the front surface thereof and surrounding drive shaft 16 to define a shaft seal cavity 20. Within shaft seal cavity 20 a shaft seal assembly 19 is assembled on drive shaft 16.

For example, a pulley (not shown) is rotatably mounted on sleeve portion 18 and is connected with drive shaft 16, in order to transmit an external power source (not shown) to drive shaft 16. Belt means (not shown) are wound around the pulley.

A disk rotor 21 is fixedly mounted on an inner end of drive shaft 16 and is born on the inner surface of front end plate 11 through a thrust needle bearing 22 which is concentrically disposed with drive shaft 16. Disk rotor 21 is provided with a drive pin 23 projecting from the rear surface thereof. Drive pin 23 is radially offset from drive shaft 16 by a predetermined amount.

Reference numerals 24 and 25 represent a pair of interfitting orbiting and fixed scroll members. The orbiting scroll member 24 includes a circular end plate 241 and a wrap means or spiral element 242 affixed onto one end surface of the end plate. End plate 241 is provided with a boss 243 projecting from the other end surface thereof and an integrally formed radial flange 244 extending radially from the projecting end of the boss. Radial flange 244 is supported on the rear end surface of disk rotor 21 by a thrust needle bearing 26 which is concentrically disposed with drive pin 23, and drive pin 23 is fitted into boss 243 with a radial needle bearing 27 therebetween so that orbiting scroll member 24 is rotatably supported on drive pin 23. The thrust load from orbiting scroll member 24 is supported on front end plate 11 through disk rotor 21. Therefore, the rotation of drive shaft 16 effects orbital motion of orbiting scroll member 24. Specifically, orbiting scroll member 24 moves along a circle of a radius of the length of the offset between drive shaft 16 and drive pin 23.

A bushing 28, of wear resistant materials may be used as shown in FIG. 1, which is fitted into boss 243 around radial bearing 27 to protect boss 243 from wear.

Means 29 for preventing orbiting scroll member 24 from rotating during orbital motion are disposed between end plate 241 and radial flange 244 of orbiting scroll member 24.

Figure 2:
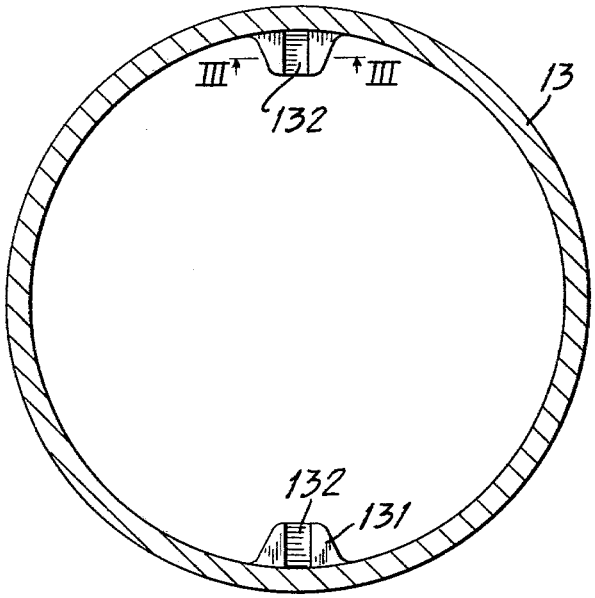
FIG. 2 is a sectional view of a compressor housing taken along line II—II in FIG. 1.
Figure 3:
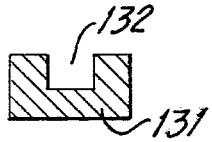
FIG. 3 is a sectional view taken along line III—III in FIG. 2.

Referring to FIGS. 2–5 in addition to FIG. 1, the rotation preventing means will be explained. Cylindrical housing 13 is provided with a pair of projections 131 which project inwardly from the inner surface of cylindrical housing 13 at opposite ends of a diameter of the cylindrical housing, as shown in FIG. 2. Each projection 131 is provided with a radially extending keyway 132 in an axial rear end surface thereof, as shown in FIGS. 2 and 3.

Figure 4:
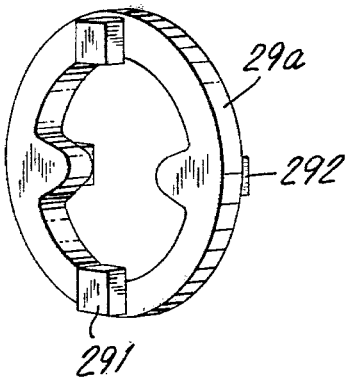
FIG. 4 is a perspective view of the slider member in FIG. 1.

A ring like slider plate member 29*a*, which has an inner diameter longer than diameter of the radial flange 244 with an outer diameter shorter than the inner diameter of cylindrical housing 13, is disposed around boss 243 and between projections 131 and end plate 241. Referring to FIG. 4, slider member 29*a* is provided with a pair of keys 291 on the front end surface at opposite ends of a diameter thereof, which are received in keyways 132 of projections 131. Slider member 29*a* is also provided with another pair of keys 292 on the rear end surface thereof. Keys 292 are located on another diameter perpendicular to the diameter on which keys 291 are located.

Figure 5:
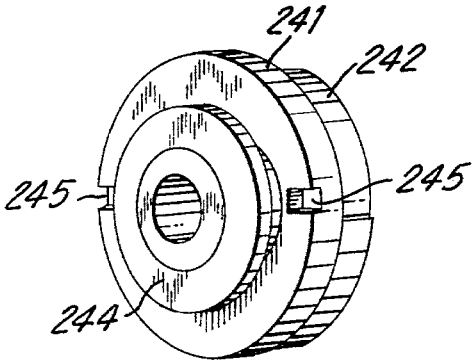
FIG. 5 is a perspective view of the orbiting scroll member in FIG. 1.
Figure 6A:
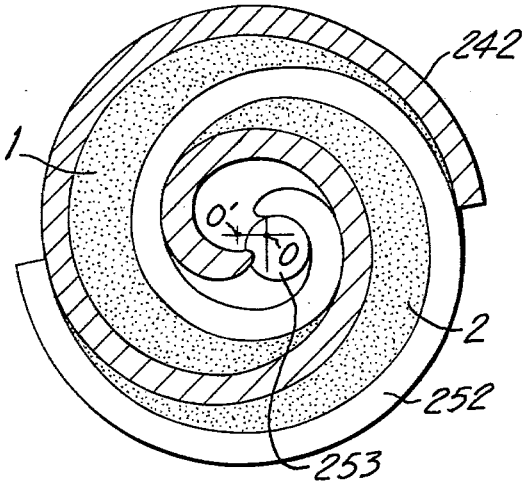
FIGS. 6*a*–6*d* are schematic views illustrating the principle of operation of the scroll-type compressor.
Figure 6B:
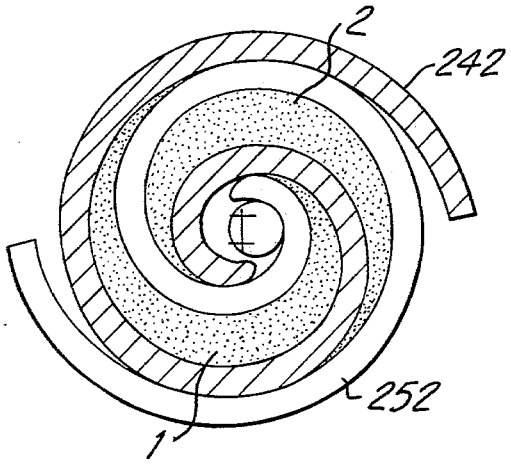
Figure 6C:
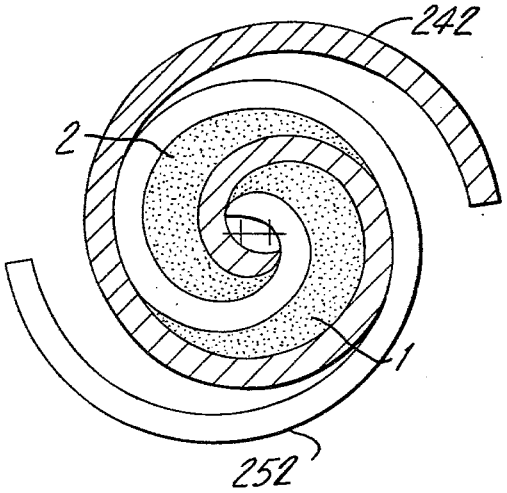
Figure 6D:
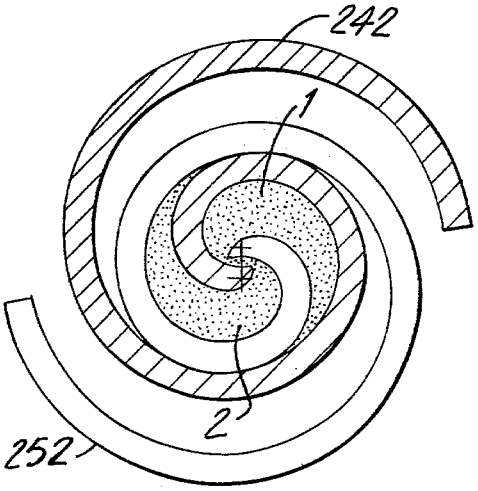
Figure 7:
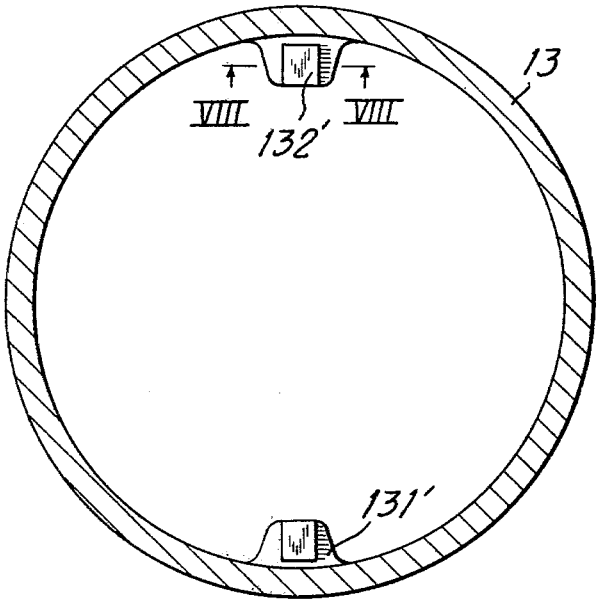
FIG. 7 is a sectional view similar to FIG. 2 of a first modification.
Figure 8:
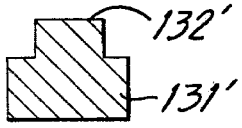
FIG. 8 is a sectional view taken along line VIII—VIII in FIG. 7.

End plate 241 of orbiting scroll member 24 is provided with a pair of keyways 245 in the front end surface to receive keys 292 of slider member 29*a*, as shown in FIG. 5.

In the arrangement, slider member 29*a* is prevented from rotation, but is permitted to move in a radial direction, by key and keyway connection 291-132. Orbiting scroll member 24 is prevented from rotating in relation to slider member 29*a*, but is permitted to move in a radial direction, by key and keyway connection 292-245. Therefore, orbiting scroll member 24 is permitted to move in two radial directions perpendicular to one another, and, thus, moves along a circle as a result of movement in the two radial directions but is prevented from rotation. Therefore, the eccentric movement of drive pin 23 by the rotation of drive shaft 16 effects orbital motion of orbiting scroll member 24 without rotation.

Fixed scroll member 25 also comprises a circular end plate 251 and a wrap means or spiral element 252 affixed onto one end surface of the end plate. End plate 251 is provided with a hole or a discharge port 253 formed at a position corresponding to the center of spiral element 252, and with an annular projection 254 on the rear end surface around discharge port 253.

Rear end plate 12 is provided with an annular projection 121 on the inner surface thereof around outlet port 15. The outer radius of annular projection 121 is slightly shorter than the inner radius of annular projection 254. Annular projection 121 is cut away along the outer edge of the projecting end to define an annular recess 122. An annular elastic material, for example, a rubber ring 30 is fitted into annular recess 122 and is compressedly held between interfitted annular projections 121 and 254, so that fixed scroll member 25 is elastically supported on annular projection 121 of rear end plate 12. Rubber ring 30 serves as a seal to seal off a chamber 31 defined by annular projections 121 and 254 from the interior space 133 of the compressor housing. Chamber 31 connects between outlet port 15 and discharge port 253 of fixed scroll member 25.

End plate 251 of fixed scroll member 25 is formed with a plurality of cut away portions 255 at its rear peripheral edge. A plurality of projections 134 are formed on the inner surface of cylindrical housing 13 of the compressor housing and are mated with cut away portions 255, so that fixed scroll member 25 is non-rotatably disposed within the compressor housing. Gaps 32 are maintained between the inner wall of cylindrical housing 13 and the peripheral end of fixed scroll member 25, and, therefore, a chamber portion 33 surrounding annular projections 121 and 254 does not form a sealed off chamber within interior space 133 of the compressor housing. Chamber portion 33 communicates with inlet port 14.

In operation, when drive shaft 16 is rotated by an external power source (not shown), drive pin 23 moves eccentrically to effect orbital motion of orbiting scroll member 24. The rotation of orbiting scroll member 24 is prevented by rotation preventing means 29. The orbital motion of orbiting scroll member 24 compresses the fluid introduced in interior space 133 through inlet port 14, chamber portion 33 and gaps 32, and the compressed gas is discharged from outlet port 15 through discharge port 253 and chamber 31.

Referring to FIGS. *6a–6d*, the introduced fluid is taken into fluid pockets 1 and 2 (which are shown as dotted regions) which are defined by the line contacts between orbiting spiral element 242 and fixed spiral element 252, as shown in FIG. *6a*. The line contacts shift by the orbital motion of orbiting spiral element 242 and, therefore, fluid pockets 1 and 2 angularly and radially move toward the center of the spiral elements and decrease in volume, as shown in FIGS. *6b–6d*. Therefore, the fluid in each pocket is compressed. When the orbiting scroll member moves 360° to the status shown in FIG. *3a*, fluid is again taken into the newly formed fluid pockets 1 and 2, while the old pockets join together to form a reduced pocket and the already compressed fluid is discharged from the reduced pocket through discharge port 253.

In the arrangement as described above, since fixed scroll member 25 is axially urged toward orbiting scroll member 24 by the restoring force of compressed rubber ring 30, sealing between end plate 241 of orbiting scroll member 24 and the axial end of fixed spiral element 252, as well as between end plate 251 of fixed scroll member 25 and the axial end of orbiting spiral element 242, is secured. The sealing is reinforced by the fluid pressure discharged into chamber 31. The axial load to secure the seal is supported on disk rotor 21 through orbiting scroll member 24 having radial flange 244, and thrust bearing 26. The axial load is further supported through the disk rotor 21 and thrust bearing 22 on front end plate 11 which is secured onto the front end of cylindrical housing 13 of the compressor housing. Therefore, any deflection of the moving parts is prevented during operation of the compressor, so that vibration of compressor and abnormal wear of the parts may be prevented. Since disk rotor 21 which is fixedly mounted on drive shaft 16 is supported through thrust bearing 22 on front end plate 11, drive shaft 16 is securely and non-vibratingly supported by the use of a single needle bearing as a radial bearing.

The radial sealing force at each line contact between fixed and orbiting spiral elements 252 and 242 is determined by the radius of orbital motion of orbiting scroll member 24 or the length offset between drive shaft 16 and drive pin 23, and the pitch and thickness of fixed and orbiting spiral elements 252 and 242. In practical use, the distance between drive shaft 16 and drive pin 23 is preferably slightly larger than half the dimensional difference between the pitch of each spiral element and the total thickness of the fixed and orbiting spiral elements. This arrangement is permitted by the fact that fixed scroll member 25 is radially movably supported by the compressed rubber ring 30. A sufficient radial seal is established, even during the initial use of the compressor as assembled. The radial seal is completed when the contact surfaces of both spiral elements wear during use to fit one another.

In the arrangement of the compressor as described above, the assembly operation of the compressor is very simple; slider member 29*a*, orbiting scroll member 24, fixed scroll member 25 and rubber ring 30 are inserted into cylindrical housing 13 from a rear opening thereof and rear end plate 12 is secured to cylindrical housing 13 by bolt means 34. Bearings 27 and 26 and a preassembly of drive pin 23, disk rotor 21, bearings 17 and 22, drive shaft 16 and front plate 11 are inserted into cylindrical housing 13 from the front opening thereof. The compressor is completed by securing front end plate 11 onto cylindrical housing 13 by bolt means 35.

Figure 9:
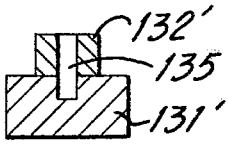
FIG. 9 is a sectional view similar to FIG. 8 of another modification.
Figure 10:
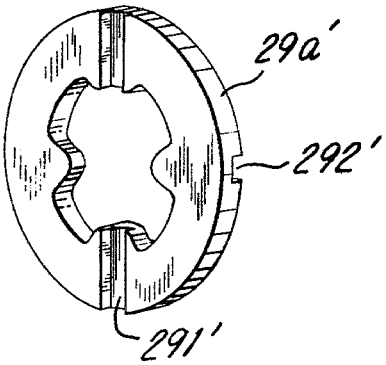
FIG. 10 is a perspective view of the slider member used together with the modification shown in FIG. 7.

Referring to FIGS. 7–10, instead of two pairs of keys slider member 29'*a* can be provided with but rather, two pair of keyways 291' and 292'. Accordingly, projections 131' of cylindrical housing 13 are not provided with a pair of keyways but instead a pair of keys 132' which are received in keyways 291' of slider member 29'*a*. Key 132' can be formed integrally with projection 131', but it may also be formed as a separate member which is secured to the projection 131' by a pin 135, as shown in FIG. 9. It will be understood that end plate 241 of orbiting scroll member 24 is not provided with keyways but a pair of keys (not shown) which are received in keyways 292' of slider member 29'*a*.

This arrangement serves to prevent the orbiting scroll member from rotating, and for permitting it to effect orbital motion, similar to the embodiment in FIGS. 1–5.

Figure 11:
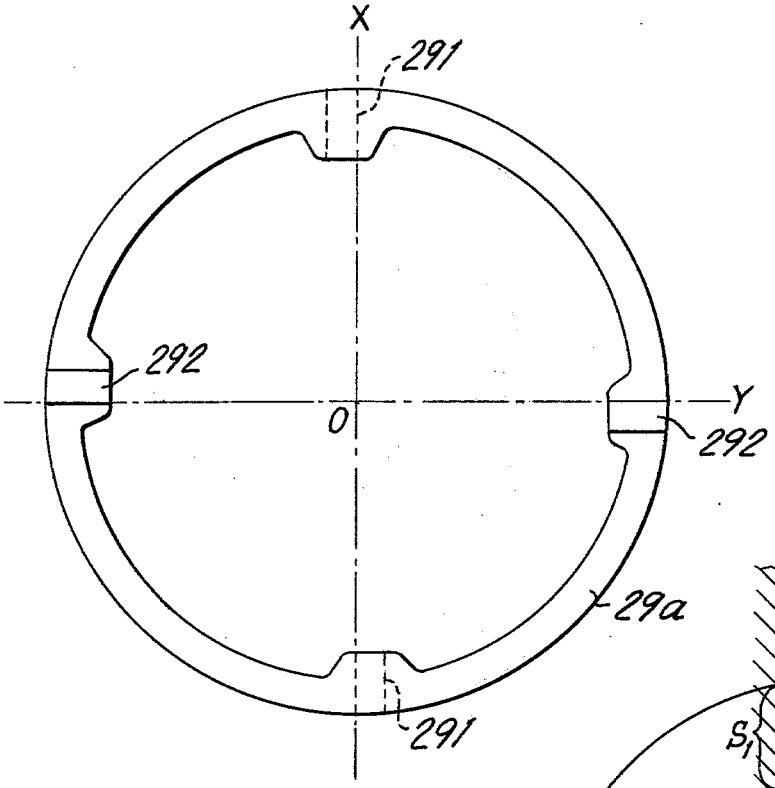
FIG. 11 is a rear view of the slider member of a modified embodiment.

Referring to FIG. 11, keys 291 of the slider member 29*a* are advantageously offset from one another so that the side surfaces of the respective keys receive a relative rotational force between the slider member and projections 131 of the cylindrical housing are on a diameter O–X of the slider member. Another pair of keys 292 are similarly offset from one another so that the side surfaces of the respective keys receive a relative rotational force between the slider member and orbiting scroll member 24 are on another diameter O–Y of the slider member.

According to the arrangement, it will be noted that keyways 132 and 245 of projections 131 and the orbiting scroll member 24 are also formed offset to receive keys 291 and 292, respectively.

This arrangement provides a greater rotation preventing force by a smaller contact surface between its key and keyway connection.

Figure 12:
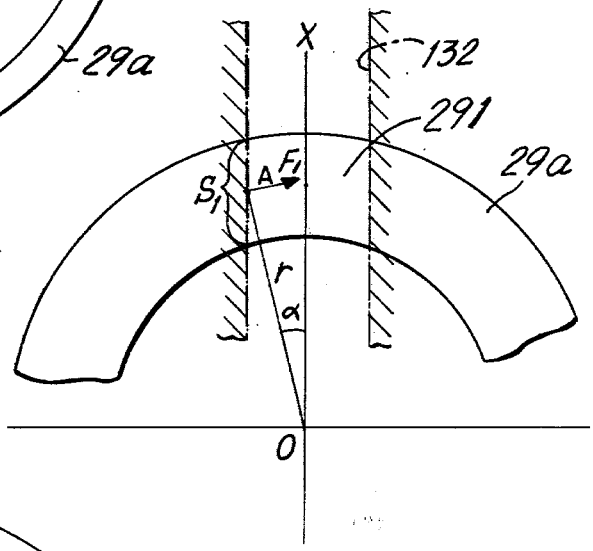
FIG. 12 is a view explaining the rotation preventing effect due to the modification as shown in FIG. 11.

Referring to FIG. 12, if a key 291 is formed so that its centerline overlies a diameter O–X of the slider member, as shown in the embodiment of FIGS. 1-5, the contact area $S_1$ between the key and the keyway for preventing rotation of the slider member in the direction as shown by arrow A will be determined as follows; assuming that the rotational torque of key 291 is T and that the resultant force of reactions at various points along the contact surface of the key is $F_1$ at a point P on the contact surface of a distance r from the center O, $$P_1 \cdot S_1 \cos \alpha = F_1$$

$$S_1 = \frac{F_1}{P_1 \cdot \cos\alpha}$$

where, $\alpha$ is the angle between $\overline{OP}$ and $\overline{OX}$, $P_1$ being the surface pressure between contact surfaces of key and keyways.

However, if key 291 is formed as shown in FIG. 11, the contact surfaces are on the diameter O-X. Therefore, under the same rotational torque T of the key, the contact area $S_2$ is determined by $S_2 = F_1/P_1$ because $\alpha = 0$.

Therefore, in the arrangement of FIG. 11, the contact area between key and keyway can be made smaller. This means that the length of each of the key and keyways can be made shorter.

A similar analysis applies to the connection between key 292 and keyway 245.

It will be understood that a similar arrangement can be employed in the embodiment in FIGS. 7-10.

Figure 14:
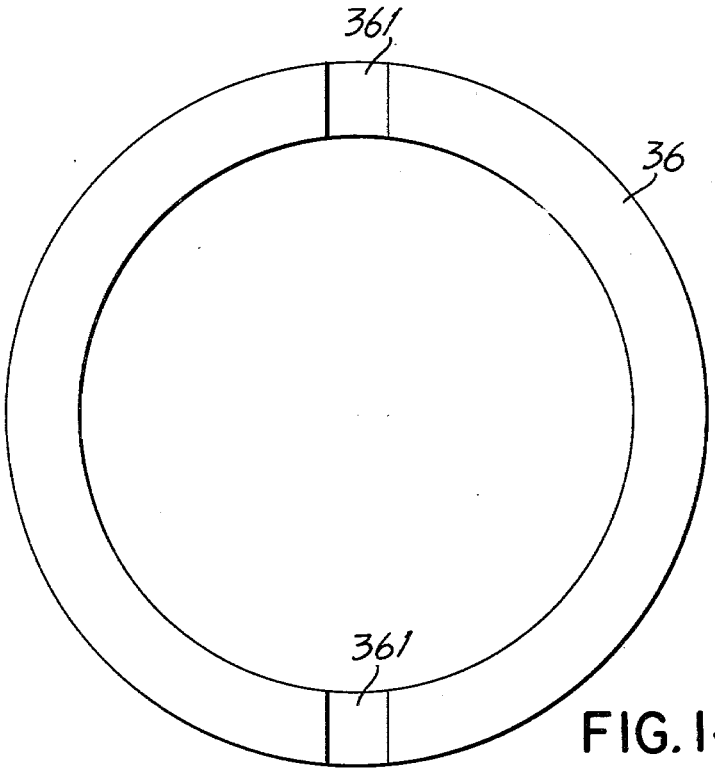
FIG. 14 is a rear view of a fixed ring used in the embodiment in FIG. 13.
Figure 13:
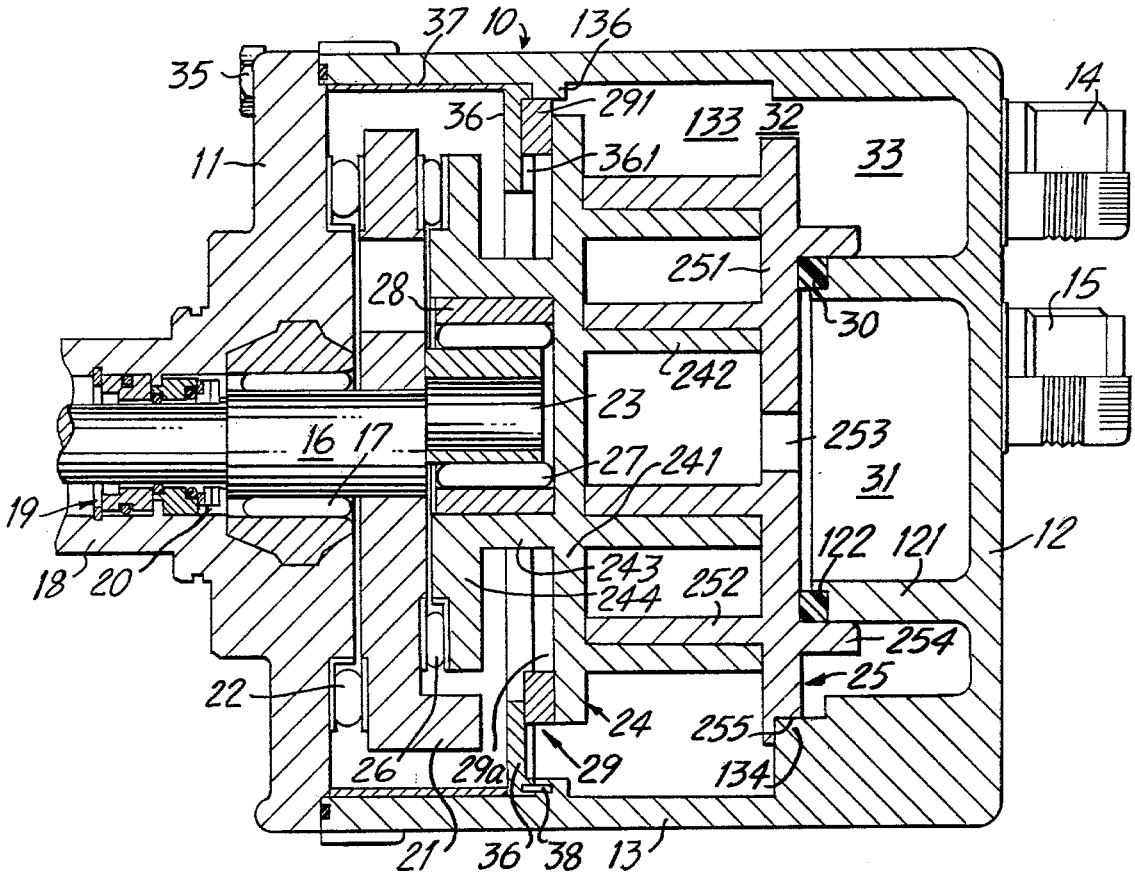
FIG. 13 is a vertical sectional view of another embodiment of this invention.

Referring to FIGS. 13 and 14, another embodiment is shown which is similar to the embodiment in FIG. 1, except that a ring 36 having a pair of keyways 361 is used in place of projections 131 in FIG. 1.

Similar parts are represented by the same reference numerals as in FIG. 1.

Ring 36 has an outer diameter equal to the inner diameter of cylindrical housing 13 and an inner diameter slightly larger than the diameter of the radial flange. If it is desired that keyways 361 are desired to be longer, radially inwardly extending portions may be formed on the inner surface at opposite ends of the diameter of the ring, on which portions keyways are formed. In this arrangement, the inner diameter of the ring should be sufficiently long to permit the radial flange to pass through the ring in an inclined condition. It will be understood that the inner contour of the ring may be oval. Cylindrical housing 13 is provided with an annular rim 136 on the inner surface thereof. A cylindrical body 37, having an outer diameter equal to the inner diameter of the cylindrical housing and having an inner diameter longer than the outer diameter of disk rotor 21, is fitted into the cylindrical housing at a front edge. Ring 36 is held between annular rim 136 and cylindrical body 37 to prevent axial movement. The front end of cylindrical body 37 engages with the inner surface of front end plate 11, so that cylindrical body 37 is held by the front end plate.

Ring 36 is prevented from rotation by means such as pins 38 which extend through ring 36 and annular rim 136, or by means of mating projections and recesses.

The pair of keyways 361 of ring 36 receive the pair of keys 291 of slider member 29*a* to guide the radial movement of the slider member.

Similar modifications as shown in FIGS. 7-10 and FIG. 11 can be applied to the embodiment shown in FIG. 13.

In the embodiment of FIG. 13, rear end plate 12 can be formed integrally with cylindrical housing 13, and the assembly operation is simplified in comparison with that of the embodiment shown in FIG. 1.

This invention has been described in detail in connection with preferred embodiments, but these embodiment are merely for example only, and this invention is not restricted thereto. It will be easily understood by those skilled in the art that the other variations and modifications may be made within the scope of this invention.

What is claimed is:

1. In a scroll-type fluid compressor unit of the type having a compressor housing with a front end plate and a rear end plate, a fixed scroll member fixedly disposed within said compressor housing and having first end plate means to which first wrap means are affixed, an orbiting scroll member orbitably disposed within said compressor housing and having second end plate means to which second wrap means are affixed, said first and second wrap means interfitting at a predetermined angular relationship at a plurality of line contacts to define at least one sealed off fluid pocket, a drive mechanism connected to said orbiting scroll member for transmitting the orbital motion to said orbiting scroll member, means for preventing rotation of said orbiting scroll member, and means for supporting a thrust force, the improvement which comprises: said drive mechanism including a drive shaft supported by a single first radial bearing means in said front end plate and extending outwardly through said front end plate, a disk rotor member mounted on an inner end of said drive shaft and supported by first thrust needle bearing means on an inner surface of said front end plate, and a drive pin axially projecting from a rear surface of said disk rotor member and being radially offset from said drive shaft, said orbiting scroll member being provided with an axial boss which is integrally formed on a surface of said second end plate member opposite said second wrap means and rotatably mounted on said drive pin which is fitted into said boss through second radial bearing means, and a radial flange portion being integral with and radially extending from, the projecting end of said axial boss and being supported by second thrust needle bearing means on the rear surface of said disk rotor member, whereby the axial force is supported on the inner surface of said front end plate through said radial flange portion, said second thrust needle bearing means, said disk rotor member and said first thrust needle bearing means so that deflection of the axis of said orbiting scroll member as well as said drive shaft is prevented, and said rotation preventing means are disposed around said axial boss.

2. The improvement as claimed in claim 1, wherein said rotation preventing means comprise a ring plate slider member having an inner diameter slightly longer than the outer diameter of said radial flange portion and an outer diameter shorter than the inner diameter of said compressor housing and disposed around said axial boss, said slider member having a first pair of radial key projections projecting from opposite ends of a diameter thereof on an axial end surface thereof and a second pair of key projections projecting from opposite ends of another diameter perpendicular to said diameter on the other axial end surface thereof, fixed guide means fixedly disposed within said compressor housing and having a first pair of keyways receiving said first key projections to permit radial movement of said slider member along said first keyways, and said second end plate of said second scroll member having a second pair of keyways for receiving said second pair of key projections to permit radial movement of said slider member along said second keyways.

3. The improvement as claimed in claim 1, wherein said rotation preventing means comprises a ring plate slider member having an inner diameter slightly longer than the outer diameter of said radial flange portion and an outer diameter shorter than the inner diameter of said compressor housing and disposed around said axial boss, said slider member having a first pair of radial keyways formed at opposite ends of a diameter thereof in an axial end surface thereof and a second pair of keyways formed at opposite ends of another diameter perpendicular to said diameter in the other axial end surface thereof, fixed guide means fixedly disposed within said compressor housing and having a first pair of radial key projections received in said first keyways to permit the radial movement of said slider member along said first key projections, and said second end plate of said second scroll member having a second pair of key projections received in said second keyways to permit the radial movement of said slider member along said second key projections.

4. The improvement as claimed in claim 2 wherein said fixed guide means is a pair of projections inwardly projecting to the inner surface of said compressor housing at opposite ends of a diameter of said compressor housing.

5. The improvement as claimed in claim 2 in which said fixed guide means are formed as a ring plate which has an outer diameter equal to the inner diameter of said compressor housing, annular rim means projecting from the inner surface of said compressor housing and engaging with said ring plate to prevent rotation, and a cylindrical body having an outer diameter equal to the inner diameter of said compressor housing and fitted into the compressor housing to keep said ring member stationary with respect to said rim means, said cylindrical body engaging said front end plate.

6. The improvement as claimed in claim 2, wherein said first key projections are offset from one another so that side surfaces of the respective first key projections which receive a relative rotational force between said slider member and said fixed guide means are on the diameter of said ring plate slider member, and said second key projections being offset from one another so that side surfaces of the respective second key projections which receive a relative rotational force between said slider member and said second scroll member are on the other diameter of said ring plate slider member.

7. The improvement as claimed in claim 3, wherein said first keyways are offset from one another so that the side surfaces of respective first keyways which receive a relative rotational force between said slider member and said fixed guide means are on the diameter of said ring plate slider member, and said second keyways being offset from one another so that side surfaces of respective second keyways which receive a relative rotational force between said slider member and said second scroll member are on the other diameter of said ring plate slider member.

* * * * *